US007736012B1

(12) United States Patent
Chu et al.

(10) Patent No.: US 7,736,012 B1
(45) Date of Patent: Jun. 15, 2010

(54) ARMORED CLIPBOARD DEVICE

(76) Inventors: Edward S. Chu, 468 Orange Blossom, Irvine, CA (US) 92618; Fannie Chu, 468 Orange Blossom, Irvine, CA (US) 92618

( * ) Notice: Subject to any disclaimer, the term of this patent is extended or adjusted under 35 U.S.C. 154(b) by 0 days.

(21) Appl. No.: 11/935,552

(22) Filed: Nov. 6, 2007

(51) Int. Cl.
*A47B 19/00* (2006.01)

(52) U.S. Cl. ..... 362/98

(58) Field of Classification Search ..... 362/98–99
See application file for complete search history.

(56) References Cited

U.S. PATENT DOCUMENTS

| | | | | |
|---|---|---|---|---|
| 3,766,865 | A | 10/1973 | Cutler | |
| 3,848,547 | A | 11/1974 | Schaefer | |
| 3,866,242 | A | 2/1975 | Slagel | |
| 4,016,666 | A | 4/1977 | Finn et al. | |
| 4,153,927 | A | 5/1979 | Owens | |
| 4,442,780 | A | 4/1984 | Child | |
| 4,892,334 | A | 1/1990 | Sinclair | |
| 4,919,037 | A | 4/1990 | Mitchell | |
| 5,554,816 | A * | 9/1996 | Skaggs et al. | 89/36.17 |
| D495,746 | S | 9/2004 | Chen | |
| 2005/0053769 | A1 * | 3/2005 | Imblum et al. | 428/170 |

* cited by examiner

*Primary Examiner*—Jason Moon Han

(57) ABSTRACT

An armored clipboard device for inhibiting a head and a torso of an officer being impacted by bullets fired from a gun includes a case being held by the officer when the officer is writing a ticket. The case includes a front wall, a back wall and a peripheral wall extending between the front wall and the back wall. The front wall has an exterior layer and an interior layer. The exterior layer is comprised of a ballistic deflecting material to deflect rounds impacting the front wall of the case. The interior layer is comprised of a ballistic absorbing layer to slow down and stop any of the rounds that penetrate the exterior layer. A handle is coupled to the case and is grasped to facilitate manipulation of the case. An illumination assembly is coupled to the case to emit light and illuminate an area in front of the officer.

1 Claim, 6 Drawing Sheets

ARMORED CLIPBOARD DEVICE

BACKGROUND OF THE INVENTION

1. Field of the Invention

The present invention relates to clipboard ballistic shields and more particularly pertains to a new clipboard ballistic shield for inhibiting a head and a torso of an officer being impacted by bullets fired from a gun.

2. Description of the Prior Art

The use of clipboard ballistic shields is known in the prior art. While these devices fulfill their respective, particular objectives and requirements, the need remains for a device that has certain improved features that allow the device to illuminate an area in front of an officer carrying the device and providing ballistic shielding from rounds fired at the officer. Additionally, the device should include strobe lights that flash high intensity light in from of the officer to blind an assailant.

SUMMARY OF THE INVENTION

The present invention meets the needs presented above by generally comprising a case being held by the officer when the officer is writing a ticket. The case includes a front wall, a back wall and a peripheral wall extending between the front wall and the back wall to define an interior space of the case. The front wall has an exterior layer and an interior layer. The exterior layer is comprised of a ballistic deflecting material to deflect rounds impacting the front wall of the case. The interior layer is comprised of a ballistic absorbing layer to slow down and stop any of the rounds that penetrate the exterior layer. A handle is coupled to and extends outwardly from the back wall of the case. The handle is grasped to facilitate manipulation of the case. An illumination assembly is coupled to the case. The illumination assembly emits light to illuminate an area in front of the officer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
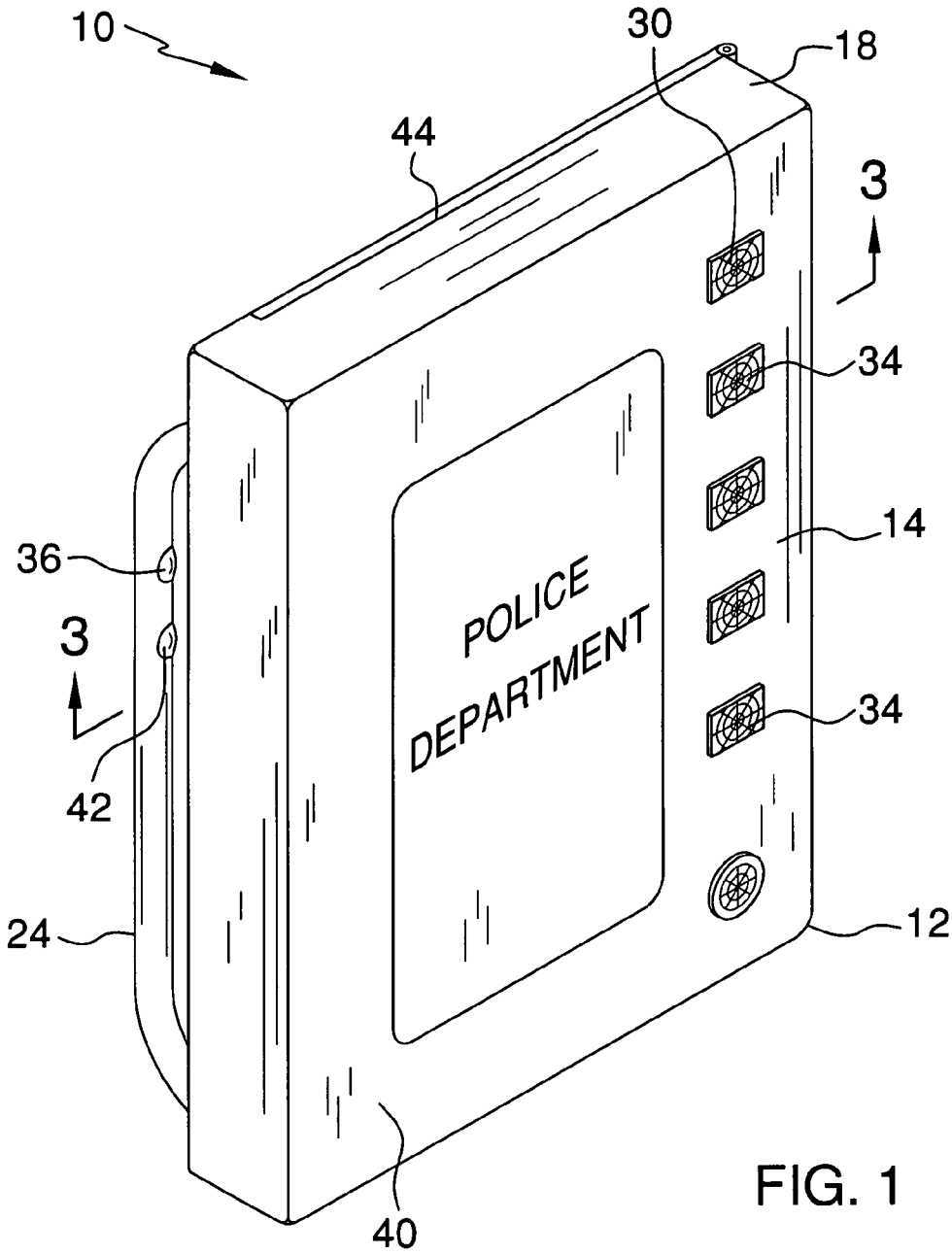
FIG. 1 is a front perspective view of an armored clipboard device according to the present invention.
Figure 2:
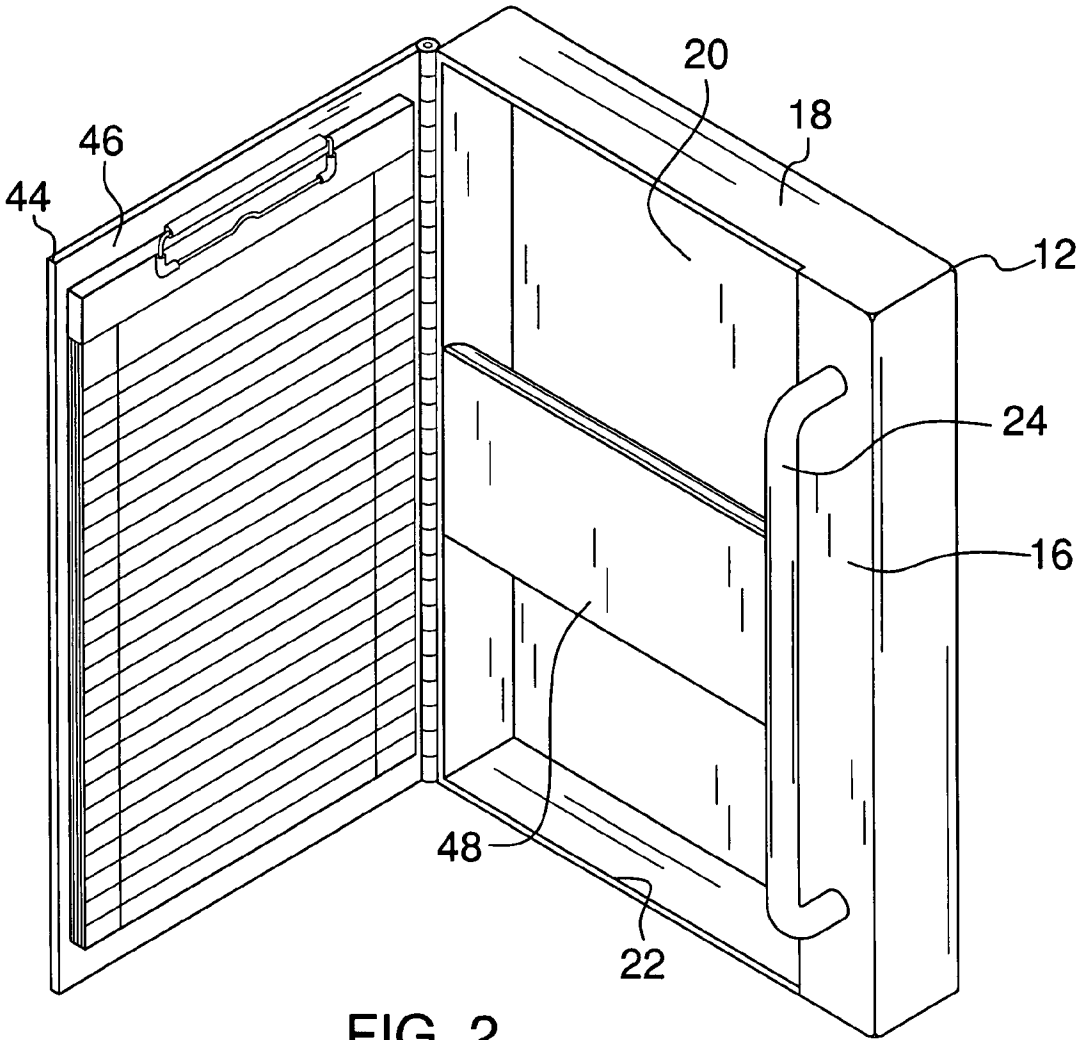
FIG. 2 is a rear perspective view of the present invention with the clipboard pivoted to permit access to the interior space of the case.
Figure 3:
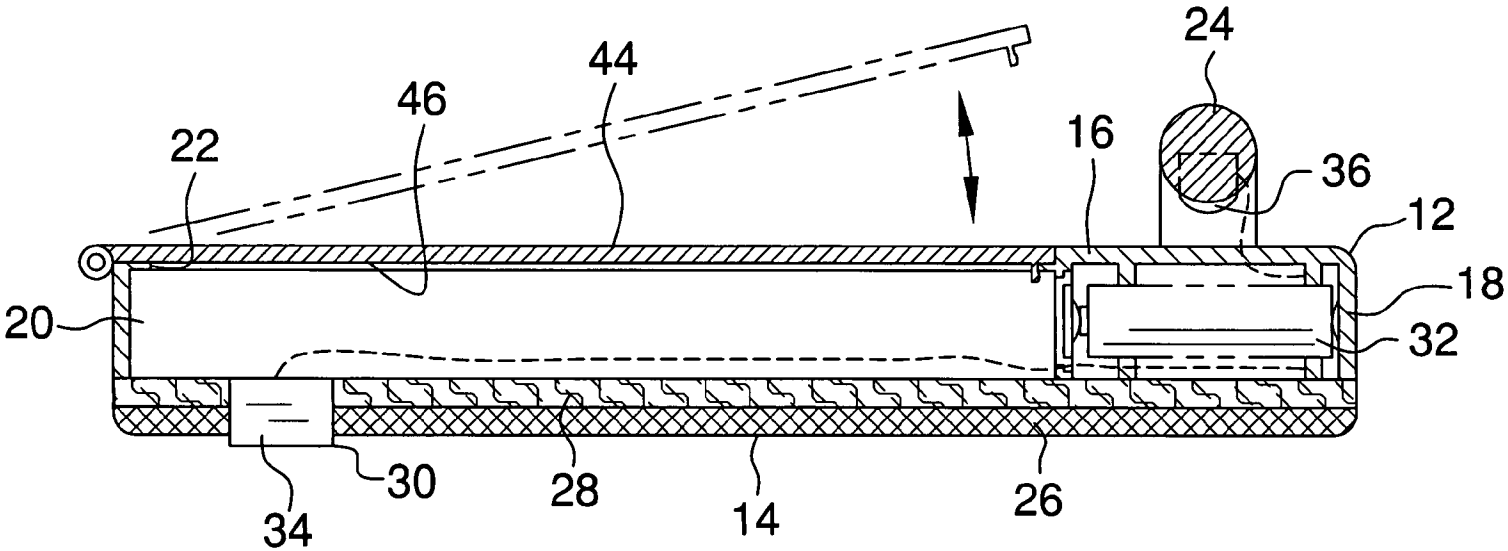
FIG. 3 is a cross-sectional view of the present invention taken along line 3-3 of FIG. 1.
Figure 4:
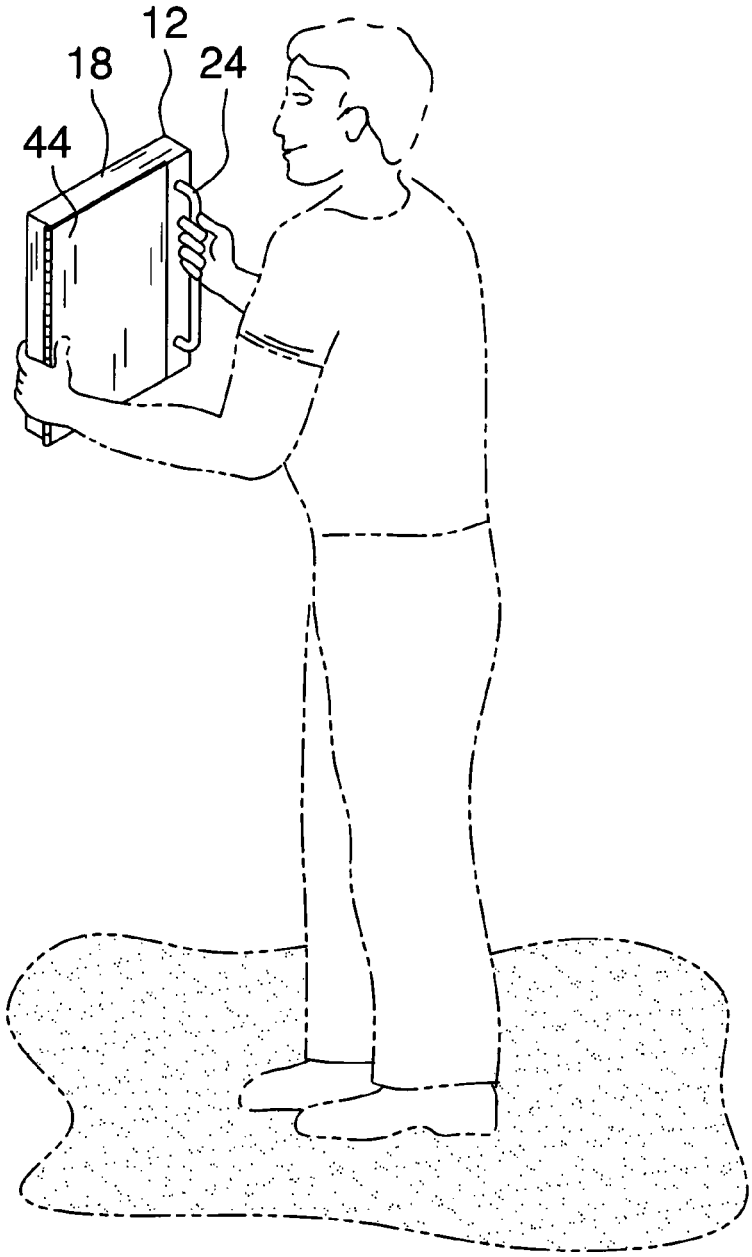
FIG. 4 is a perspective view of the present invention shown in use.
Figure 5:
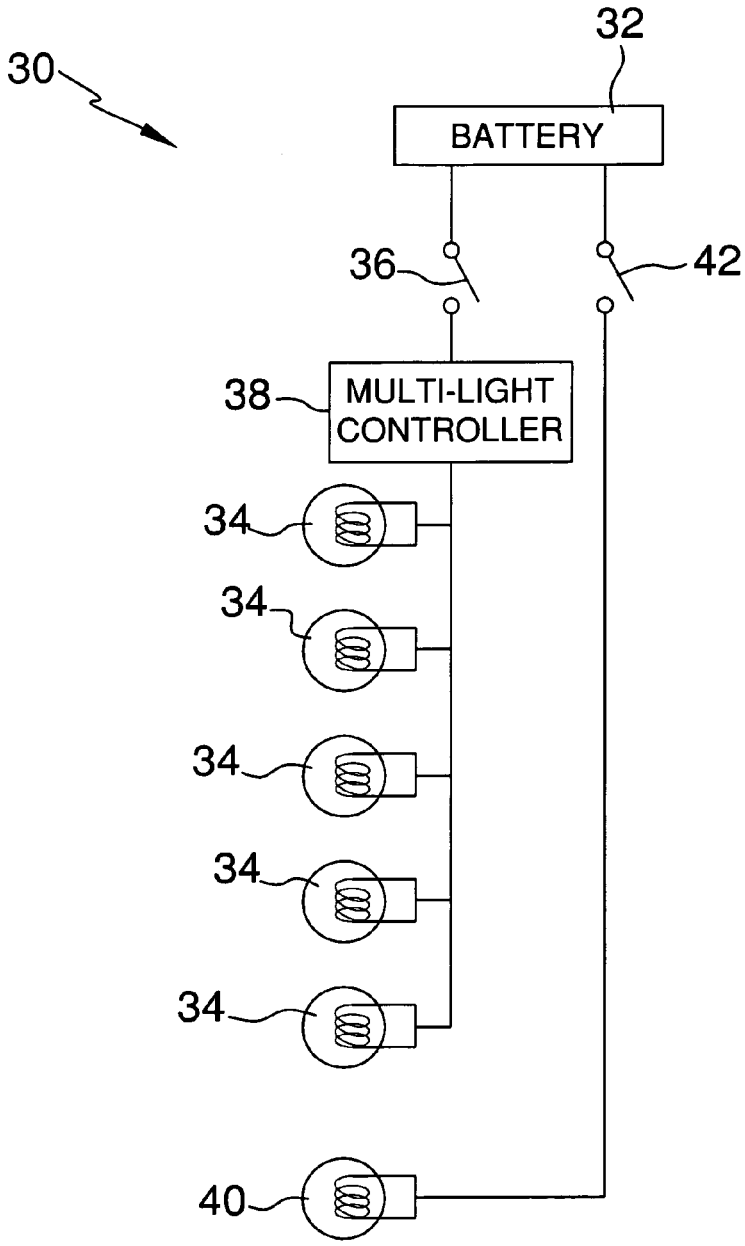
FIG. 5 is a schematic view of the illumination assembly of the present invention.
Figure 6:
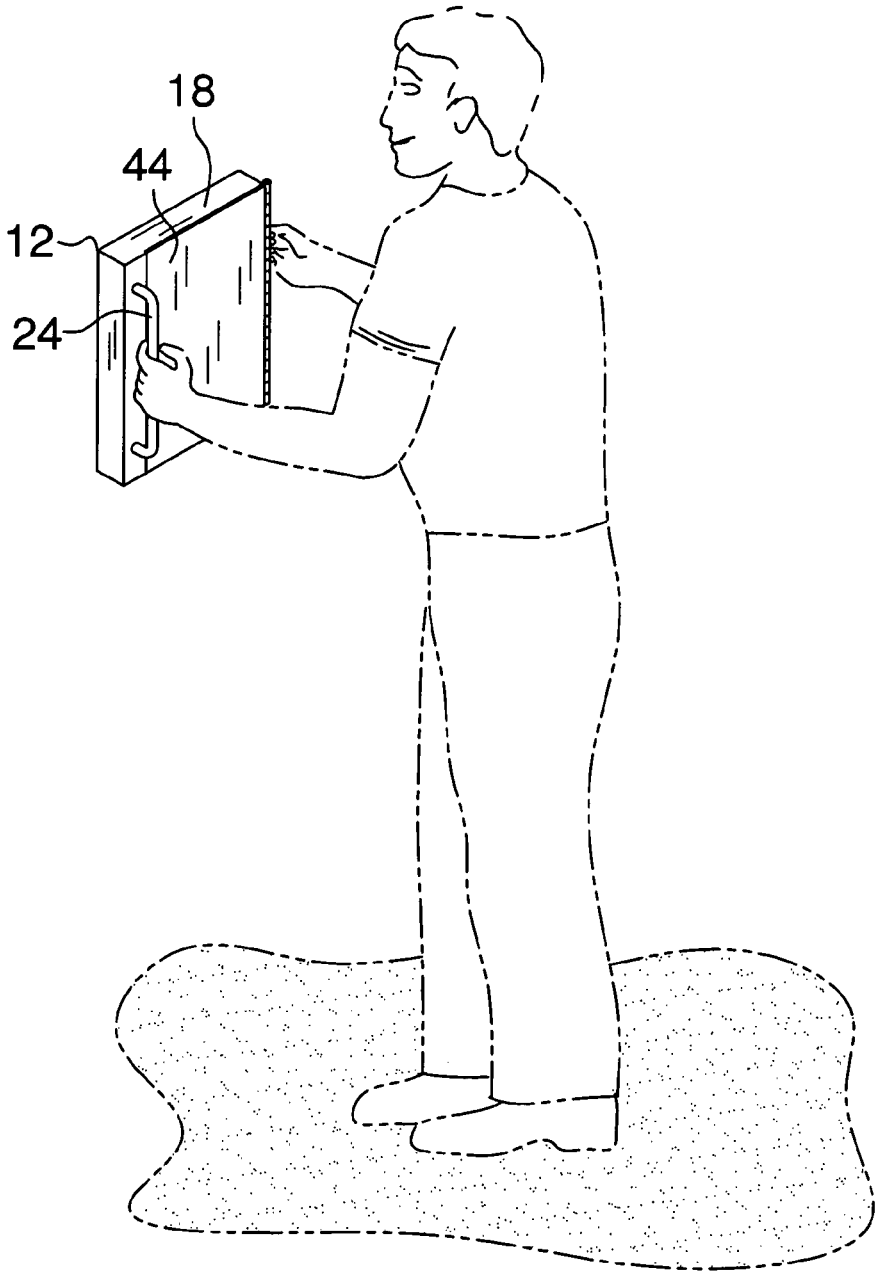
FIG. 6 is a perspective view of the present invention shown in use.

With reference now to the drawings, and in particular to FIGS. 1 through 6 thereof, a new clipboard ballistic shield embodying the principles and concepts of the present invention and generally designated by the reference numeral 10 will be described.

As best illustrated in FIGS. 1 through 6, the armored clipboard device 10 generally comprises a case 12 being held by an officer when the officer is writing a ticket. The case 12 includes a front wall 14, a back wall 16 and a peripheral wall 18 that extends between the front wall 14 and the back wall 16 to define an interior space 20 of the case 12. The case 12 has an access aperture 22 that extends through the back wall 16 to permit access to the interior space 20. A handle 24 is coupled to and extends outwardly from the back wall 16 of the case 12. The handle 24 is grasped to facilitate manipulation of the case 12. The handle 24 may being positioned adjacent to one of a pair of sides of the case 12 to accommodate either left or right handed people.

The front wall 14 has an exterior layer 26 and an interior layer 28. The exterior layer 26 is comprised of a ballistic deflecting material to deflect rounds impacting the front wall 14 of the case 12. The interior layer 28 is comprised of a ballistic absorbing layer to slow down and stop any of the rounds that penetrate the exterior layer 26.

An illumination assembly 30 is coupled to the case 12. The illumination assembly 30 emits light to illuminate an area in front of the officer. The illumination assembly 30 includes a power supply 32 positioned in the interior space 20 of the case 12. A plurality of strobe lights 34 is electrically coupled to the power supply 32. The strobe lights 34 are coupled to the front wall 14 of the case 12. The strobe lights 34 emit a high intensity light to temporarily blind a person in front of the officer when the strobe lights 34 receive power from the power supply 32.

The illumination assembly 30 also includes a strobe button 36 electrically coupled between the power supply 32 and the strobe lights 34. The strobe button 36 is coupled to the handle 24. The strobe button 36 is actuatable to control the supply of power to the strobe lights 34 from the power supply 32. A strobe unit 38 is electrically coupled between the strobe lights 34 and the strobe button 36. The strobe unit 38 is positioned in the casing. The strobe unit 38 controls power to the strobe lights 34 to sequentially turn the strobe lights 34 on and off to emit flashes of high intensity light from the strobe lights 34 and temporarily blind the person when the strobe unit 38 receives power from the power supply 32.

The illumination assembly 30 additionally includes a light emitter 40 electrically coupled to the power supply 32. The light emitter 40 is coupled to the front wall 14 of the case 12. The light emitter 40 emits light to illuminate the area in front of the officer when the light emitter 40 receives power from the power supply 32. A light button 42 is electrically coupled between the power supply 32 and the light emitter 40. The light button 42 is coupled to the handle 24. The light button 42 is actuatable to control the supply of power to the light emitter 40 from the power supply 32. The strobe lights 34 and the light emitter 40 are positioned adjacent a side of the case 12 opposite that of the handle 24.

A clip board 44 is hingedly coupled, to the case 12. The clip board 44 receives documents to be written on by the officer. The clip board 44 is positioned adjacent the access aperture 22 of the case 12. The clip board 44 is pivotable over the access aperture 22 to selectively close the access aperture 22. An interior face 46 of the clip board 44 receives the documents to permit the documents to be positioned in the interior space 20 of the case 12 when the clip board 44 is pivoted over the access aperture 22.

A document retainer 48 is coupled to the case 12 and positioned in the interior space 20 of the case 12. The document retainer 48 is positioned adjacent the access aperture 22 to permit documents to be placed in the interior space 20 between the document retainer 48 and the front wall 14 to inhibit the documents inadvertently falling out of the interior space 20. The document retainer 48 extends across a width of the access aperture 22.

In use, as the officer approaches a vehicle, the officer presses the light button 42 to illuminate the area in front of the officer. The clip board 44 is pivoted to allow the officer to access documents that may be required to writer a driver of the vehicle a ticket. Should the driver shoot a gun at the officer, the case 12 can be held in front of the officer as the officer retreats to deflect and absorb the rounds being shot at a head and body of the officer. The officer may press the strobe button 36 which will cause the strobe lights 34 to emit flashes of high intensity light to temporarily blind the driver to further impede the aim of the driver.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An armored clipboard device for providing a defense for an officer, said device comprising:

a case being held by the officer when the officer is writing a ticket, said case including a front wall, a back wall and a peripheral wall extending between said front wall and said back wall to define an interior space of said case, said case having an access aperture extending through said back wall to permit access to said interior space, said front wall having an exterior layer and an interior layer, said exterior layer being comprised of a ballistic deflecting material to deflect rounds impacting said front wall of said case, said interior layer being comprised of a ballistic absorbing layer to slow down and stop any of the rounds that penetrate said exterior layer;

a handle being coupled to and extending outwardly from said back wall of said case, said handle being grasped to facilitate manipulation of said case;

an illumination assembly being coupled to said case, said illumination assembly emitting light to illuminate an area in front of the officer, said illumination assembly comprising;

a power supply being positioned in said interior space of said case;

a plurality of strobe lights being electrically coupled to said power supply, said strobe lights being coupled to said front wall of said case, said strobe lights emitting a high intensity light to temporarily blind a person in front of the officer when said strobe lights receive power from said power supply;

a strobe button being electrically coupled between said power supply and said strobe lights, said strobe button being coupled to said handle, said strobe button being actuatable to control the supply of power to said strobe lights from said power supply;

a strobe unit being electrically coupled between said strobe lights and said strobe button, said strobe unit being positioned in said casing, said strobe unit controlling power to said strobe lights to sequentially turn said strobe lights on and off to emit flashes of high intensity light from said strobe lights and temporarily blind the person when said strobe unit receives power from said power supply;

a light emitter being electrically coupled to said power supply, said light emitter being coupled to said front wall of said case, said light emitter emitting light to illuminate the area in front of the officer when said light emitter receives power from said power supply;

a light button being electrically coupled between said power supply and said light emitter, said light button being coupled to said handle, said light button being actuatable to control the supply of power to said light emitter from said power supply;

a clip board being hingedly coupled to said case, said clip board receiving documents to be written on by the officer, said clip board being positioned adjacent said access aperture of said case, said clip board being pivotable over said access aperture to selectively close said access aperture, an interior face of said clip board receiving the documents to permit the documents to be positioned in said interior space of said case when said clip board is pivoted over said access aperture; and a document retainer being coupled to said case and positioned in said interior space of said case, said document retainer being positioned adjacent said access aperture to permit documents to be placed in said interior space between said document retainer and said front wall to inhibit the documents inadvertently falling out of said interior space, said document retainer extending across a width of said access aperture.

* * * * *